US006609854B2

(12) United States Patent
Okazaki

(10) Patent No.: US 6,609,854 B2
(45) Date of Patent: Aug. 26, 2003

(54) STRUCTURE AND METHOD FOR DETECTING AN INFLATED STATE OF A FLEXIBLE MEMBRANE DAM

(75) Inventor: Yasuo Okazaki, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 10/143,975

(22) Filed: May 14, 2002

(65) Prior Publication Data

US 2002/0197112 A1 Dec. 26, 2002

(30) Foreign Application Priority Data

Jun. 26, 2001 (JP) ..... 2001-193400

(51) Int. Cl.[7] ..... E01F 5/00; E02B 7/20; E02B 7/02

(52) U.S. Cl. ..... 405/91; 405/92; 405/110; 405/115; 405/124; 137/218; 137/488; 324/326

(58) Field of Search ..... 405/52, 54, 80, 405/92, 98, 107, 115, 124, 184.3; 137/217, 218, 423, 488; 138/97, 98; 324/326

(56) References Cited

U.S. PATENT DOCUMENTS 4,091,624 A * 5/1978 Steinke ..... 405/96
4,114,381 A * 9/1978 Lundh ..... 405/94
4,119,908 A * 10/1978 Cosman et al. ..... 324/326
4,151,458 A * 4/1979 Seager ..... 324/329
4,324,506 A * 4/1982 Steinke ..... 405/96
4,767,237 A * 8/1988 Cosman et al. ..... 324/326
4,781,958 A * 11/1988 Gilbert ..... 428/76
4,832,069 A * 5/1989 Gale et al. ..... 405/154.1
5,045,368 A * 9/1991 Cosman et al. ..... 324/326
5,829,917 A * 11/1998 Maudal ..... 405/52

FOREIGN PATENT DOCUMENTS

JP 59145812 * 8/1984
JP 59217822 * 12/1984
JP 04293809 * 10/1992 ..... 405/91
JP 2001-20263 1/2001

* cited by examiner

*Primary Examiner*—Jong-Suk Lee
(74) *Attorney, Agent, or Firm*—Oliff & Berridge, PLC

(57) ABSTRACT

A structure for detecting an inflated state of a dam formed by a flexible membrane disposed in a conduit, with the detection unaffected by pressure resulting from fluid flow through the conduit when the flexible membrane is not completely inflated. The structure includes a metal plate mountable at a center of the flexible membrane and covered by a covering sheet and a metal detector for detecting the metal member only when the flexible membrane has been inflated to a desired state.

22 Claims, 10 Drawing Sheets

STRUCTURE AND METHOD FOR DETECTING AN INFLATED STATE OF A FLEXIBLE MEMBRANE DAM

BACKGROUND OF THE INVENTION

1. Field of the Invention

The present invention relates to a structure and method for detecting an inflated state of a dam formed by a flexible membrane disposed in a culvert, with the flexible membrane being inflated due to fluid being supplied thereto and being deflated due to fluid being discharged therefrom.

2. Description of the Related Art

Conventionally, a dam formed by a flexible membrane has been used as a sluice gate disposed in a conduit (such as a sluice pipe) crossing a levee, and as an adjusting gate or a checking gate disposed in a culvert such as a sewage pipe or a water conduit.

When fluid (such as air or water) is supplied inside the flexible membrane, the flexible membrane is inflated to close watercourses such as a river. When the fluid is discharged, the flexible membrane is deflated to open the watercourses.

Because the flexible membrane dam is disposed inside the conduit or the like and cannot be seen from the outside, sometimes a pressure detector is used to determine whether the flexible membrane dam has been completely inflated by detecting whether pressure within the flexible membrane has reached a specified value. However, there are cases in which the pressure detector cannot accurately detect that the flexible membrane has actually been completely inflated due to slight errors in the pressure detection.

In view of this drawback, an alternative structure shown in FIGS. 10A and 10B has been suggested (see Japanese Patent Application Laid-Open No. 2001-20263), in which a diaphragm-type pressure detector 116 is mounted on a ceiling 114 of a conduit 112. When a flexible membrane 118 has been completely inflated, the flexible membrane 118 contacts the ceiling 114, and a compressive force is exerted on the pressure detector 116 by air pressure inside the flexible membrane 118. The diaphragm of the pressure detector 116 is thereby deformed, and the deformation of the diaphragm is electrically detected by the pressure detector 116. In this manner, whether the flexible membrane 118 has been completely inflated can be remotely verified in a handling room 120.

However, when a compressive force exerted on the diaphragm is used to detect the fully inflated state of the flexible membrane 118, accurate detection is problematic because the diaphragm is also presumably distorted by water pressure or the like when the flexible membrane 118 is deflated.

SUMMARY OF THE INVENTION

In view of the above facts, it is an object of the present invention to obtain a structure and method that can detect with greater accuracy an inflated state of a flexible membrane dam and are unaffected by pressure resulting from fluid flow when the flexible membrane is not completely inflated.

In accordance with a first aspect of the present invention, a structure for detecting an inflated state of a dam formed by a flexible membrane disposed in a culvert, with the flexible membrane being inflated due to fluid being supplied thereto and being deflated due to fluid being discharged therefrom, the structure comprises: a metal member mountable on the flexible membrane; and a metal detector for detecting the metal member, the metal detector being mountable in the culvert at a position corresponding to the metal member when the flexible membrane has been inflated.

When the flexible membrane is inflated due to fluid being supplied thereto, the metal member disposed on the flexible membrane moves toward the culvert. Since the metal detector is mounted in the culvert at the position corresponding to the metal member when the flexible membrane has been inflated, the metal detector detects the metal member when the flexible membrane has been completely inflated. In this manner, the metal detector detects the metal member, whereby the inflated state of the flexible membrane dam can be detected. Since this structure detects the inflated state thereof without conventionally detecting pressure, the inflated state can be accurately detected without being affected by fluid pressure.

As the metal detector, any commonly used conventional metal detector can be used.

In accordance with the first aspect of the present invention, the metal member is usually disposed at a substantial center of the flexible membrane when viewed in a direction in which the flexible membrane inflates.

The center of the flexible membrane is moved in a large amount when the flexible membrane is inflated and deflated. Therefore, the metal member is disposed at the center (when viewed in the inflation direction) of the flexible membrane, whereby the inflated state can be more accurately detected.

In accordance with the first aspect of the present invention, the metal member is usually a tabular metal plate.

The metal member may be spherical, rectangular parallelepiped, block-shaped, etc. However, when the metal member is tabular, protrusion from the flexible membrane can be reduced.

In accordance with the first aspect of the present invention, the structure further usually comprises a covering member for covering at least part of the metal member.

Accordingly, at least the portion of the metal member that is covered with the covering member can be protected. The metal member may be completely covered with only the covering member, or with both the covering member and an additional cloth member, so that the metal member can be more reliably protected.

In accordance with the first aspect of the present invention, the metal member is usually not attached to the flexible membrane.

When the fluid is supplied, the flexible membrane extends/contracts in its directions. If the metal member is not attached to the flexible membrane, the metal member remains unaffected by distortion of the flexible membrane. In the structure including the covering member, when the flexible membrane extends/contracts, the covering member may also extend/contract. In this case, similarly, if the metal member is not attached to the covering member, contact between the metal member and the covering member is unaffected by distortion of the flexible membrane.

In accordance with the first aspect of the present invention, a periphery of the covering member usually tapers away from a center of the covering member.

Accordingly, when the flexible membrane has been completely inflated, a clearance generated between the flexible membrane and the culvert is reduced (preferably eliminated), and occlusion of the culvert is improved.

When the flexible membrane is deflated, an area thereof opposing the direction that the fluid flows in the culvert is reduced (preferably eliminated). Therefore, foreign substances flowing together with the fluid are not often caught, and durability of the covering member is improved.

In accordance with the first aspect of the present invention, an outer edge of the covering member outwardly extrudes from that of the metal member usually by 100 mm or more.

Accordingly, the metal member can be completely covered with only the covering member, or with both the covering member and the additional cloth member. Further, the portion of the covering member that outwardly extrudes from the metal member can be securely attached to the flexible membrane.

In accordance with the first aspect of the present invention, the covering member usually comprises a thickness within a range of from 2 mm to 10 mm.

When the thickness of the covering member is at most 10 mm, the amount of protrusion from the flexible membrane can be reduced. When the thickness is at least 2 mm, the strength of the covering member can be obtained.

In accordance with the first aspect of the present invention, a covering unit that includes the metal member and the covering member is usually attached to the flexible membrane.

Accordingly, if the covering unit has been produced in a factory, only attachment of the covering unit to the flexible membrane is needed on a site, and thus, execution property thereof is improved.

In accordance with the first aspect of the present invention, a cloth member for covering at least some corners of the metal member is usually mountable between the metal member and the covering member.

Accordingly, loads applied from the corners of the metal member to the covering member are eased by the cloth member, and the covering member can be prevented from being damaged.

In accordance with the first aspect of the present invention, at least some corners of the metal member are usually chamfered so as to have a predetermined curvature.

Accordingly, even if the corners of the metal member contact the covering member, local loads are reduced by the chamfered portions, and the covering member can be prevented from being damaged.

The chamfered portions may be formed, for example, by chamfering the corners of the metal plate viewed in a normal direction, or by rounding ends (edges) of the metal plate in a thickness direction viewed in the thickness direction.

In accordance with the first aspect of the present invention, the metal plate is usually substantially circular.

Since the entire periphery of the circular metal plate has a predetermined curvature, the covering member can be reliably prevented from being damaged. Further, orientation of the circular metal plate does not need to be considered when the circular metal plate is disposed on the flexible membrane.

In accordance with the first aspect of the present invention, the metal plate is usually substantially elliptical.

Since the entire periphery of the elliptical metal plate may have a predetermined or smaller value of curvature, the covering member can be reliably prevented from being damaged. Further, if the position of the elliptical metal plate is deviated when the flexible membrane is inflated, the elliptical metal plate can be disposed so that effect of the deviation is reduced. For example, when the flexible membrane is pressed by fluid flow in the culvert, the center position of the flexible membrane may shift downstream. Therefore, if the elliptical metal plate is disposed so that a longitudinal direction thereof corresponds to the flow direction, the effect of the shift is reduced (preferably eliminated), and the elliptical metal plate can be reliably detected by the metal detector.

The "elliptical" shape widely includes a general ellipsoidal shape, a substantially ellipsoidal shape in which semicircles are continuously connected to ends of two parallel lines, and a shape in which curvatures at ends of a major axis or a minor axis are different from each other (so-called "oval" shape).

In accordance with the first aspect of the present invention, the metal plate comprises an outside dimension within a range of from 50 mm to 1,000 mm.

When the outside dimension of the metal plate is at least 50 mm, the metal plate can be reliably detected by the metal detector, and when the outside dimension is at most 1,000 mm, distortion applied to the metal plate when the flexible membrane is inflated can be reduced, and increase of weight of this structure can be restricted.

In accordance with the first aspect of the present invention, the metal plate comprises a thickness usually within a range of from 2 mm to 10 mm.

When the thickness of the metal plate is at most 10 mm, the amount of protrusion from the flexible membrane can be reduced. When the thickness is at least 2 mm, the strength of the metal plate can be obtained.

In accordance with the first aspect of the present invention, the metal member usually comprises rust-proofing. Accordingly, the metal member can be prevented from rusting.

A second aspect of the present invention is a method for detecting an inflated state of a dam formed by a flexible membrane disposed in a culvert, the method comprising the steps of: (a) disposing a metal member on the flexible membrane; (b) mounting a metal detector on an inner surface of the culvert; and (c) adjusting a position of at least one of the metal member and the metal detector so that the metal detector detects the metal member only when the flexible membrane has been inflated.

DESCRIPTION OF THE PREFERRED EMBODIMENT

Figure 1B:
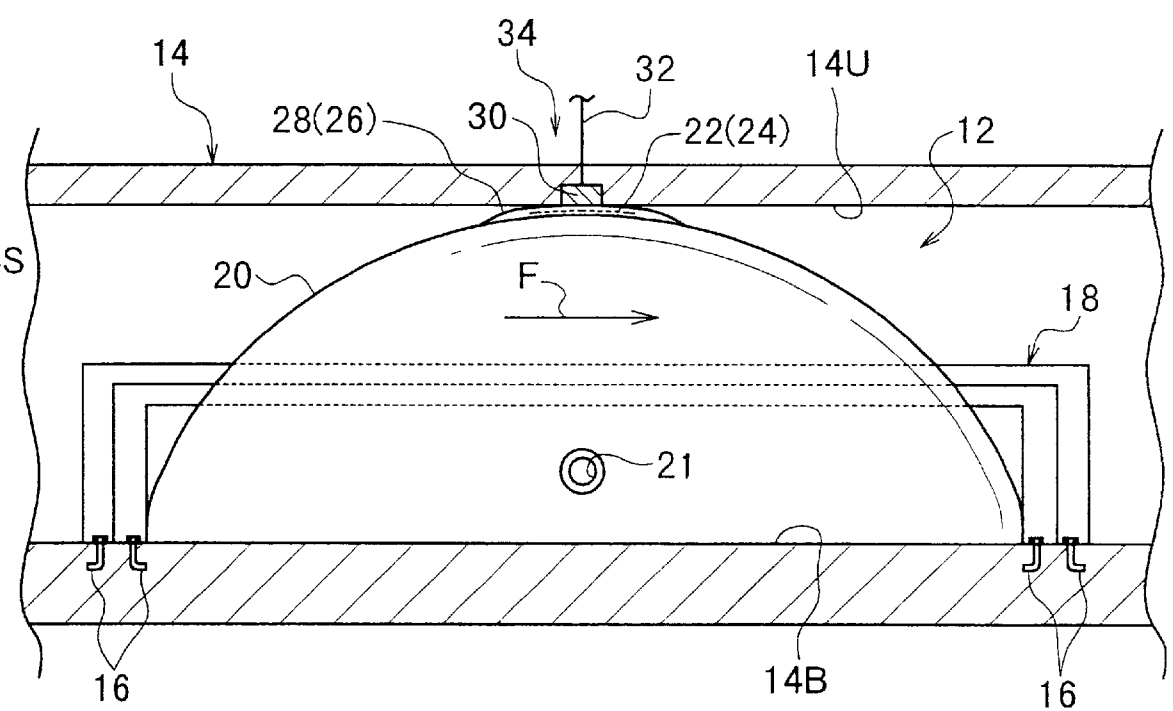
FIG. 1B is a cross-sectional view of the gate of FIG. 1A seen in a flow direction of the fluid.
Figure 1A:
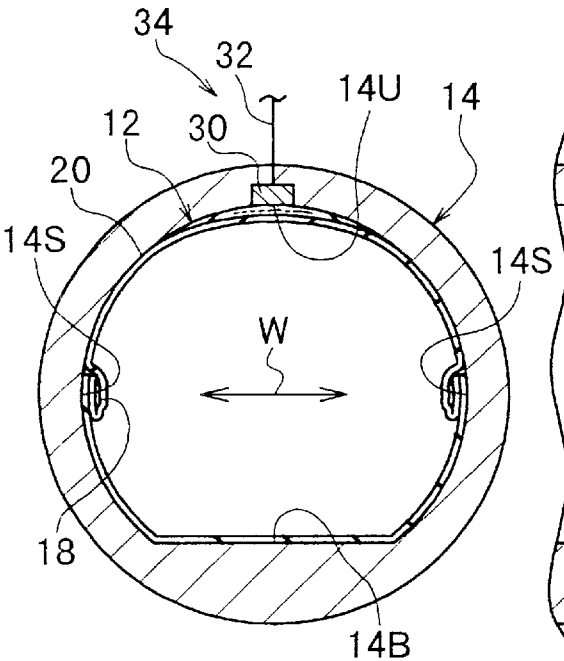
FIG. 1A is a cross-sectional view of a gate, to which a structure according to a preferred embodiment of the present invention has been applied, seen in a direction orthogonal to fluid flow.

FIGS. 1A and 1B are cross-sectional views of a conduit 14 in which a gate 12 according to a preferred embodiment of the present invention is disposed. Although the conduit 14 in the present embodiment is substantially cylindrical, the shape of the conduit 14 is not limited. In FIG. 1B, a state is shown in which fluid flow in the conduit 14 is dammed off by the gate 12, with the direction of flow being from left to right and indicated by arrow F. Hereinafter, this direction is simply referred to as "flow direction" or "longitudinal direction", and a direction horizontally orthogonal thereto is simply referred to as "width direction" and is indicated by arrow W in FIG. 1A.

A plurality of mounting brackets is mounted in the conduit 14 by mounting members such as bolts 16, and the mounting brackets together form a frame-shaped mounting bracket structure 18. The gate 12 has at least one flexible membrane 20, and the flexible membrane 20 is mounted at its periphery to the conduit 14 by the bolts 16.

The flexible membrane 20 includes a reinforcing layer (e.g., a reinforcing cloth 40) formed by an elastic body (e.g., rubber or synthetic resin) having disposed therein one or more sheets comprising fiber cord or fabric, such as cotton, synthetic fiber or the equivalent. However, the flexible membrane 20 does not necessarily include the reinforcing layer. Further, the gate 12 may have two flexible membranes 20 comprising an upper membrane and a lower membrane. When the gate 12 has one flexible membrane 20, it substantially has only an upper membrane.

An opening 21, through which fluid is supplied to or discharged from the flexible membrane 20, is formed in a side surface 14S of the conduit 14 and is connected to an unillustrated pump. When air is not supplied from the pump, the flexible membrane 20 is not inflated and lies flat along a lower surface 14B of the conduit 14 so as not to obstruct fluid flow in the conduit 14. When air is supplied from the pump, the flexible membrane 20 (upper membrane) is inflated into a substantially hemispherical shape. As a result, the flexible membrane 20 partially contacts an upper surface 14U and the side surfaces 14S of the conduit 14. When completely inflated, the flexible membrane 20 prevents fluid flow in the conduit 14.

Figure 2:
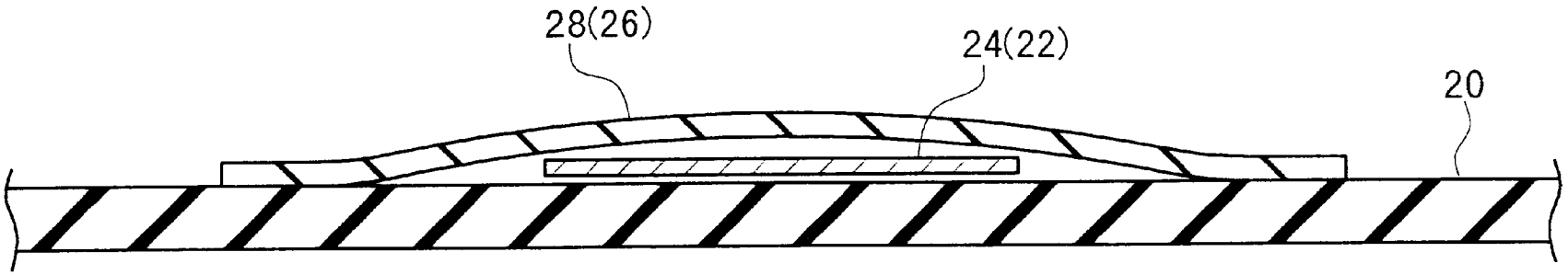
FIG. 2 is a partially enlarged cross-sectional view, in the vicinity of a metal plate, of a flexible membrane according to the embodiment.
Figure 3:
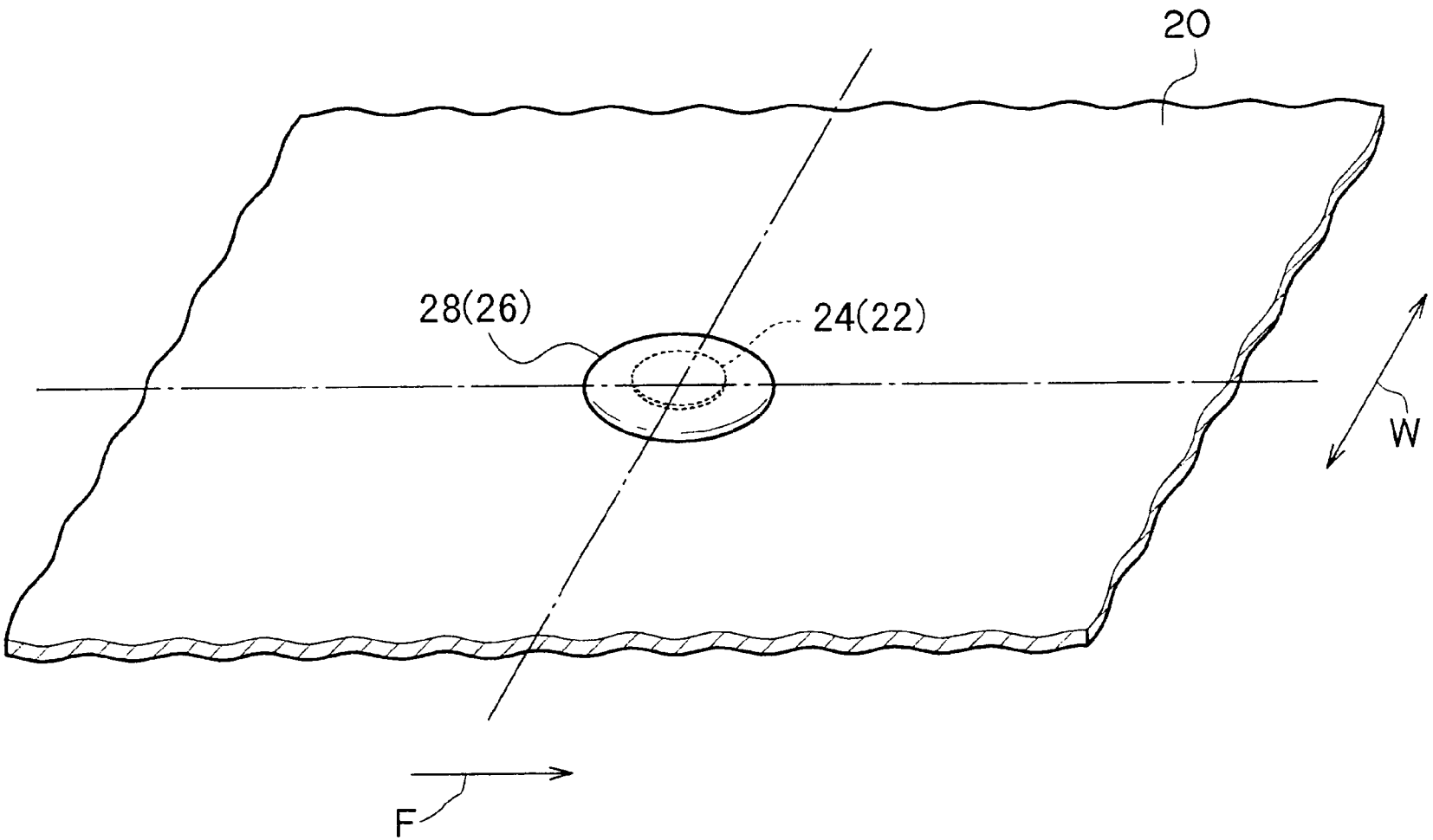
FIG. 3 is a partially enlarged perspective view, in the vicinity of the metal plate, of the flexible membrane according to the embodiment.

As shown in FIGS. 2 and 3, a circular metal plate 24, which is an example of a metal plate 22 according to the present invention, is disposed on a substantial center of the flexible membrane 20 (i.e., an area of the flexible membrane 20 that contacts the upper surface 14U of the conduit 14 when the flexible membrane 20 is completely inflated). A covering sheet 28, which is an example of a covering member 26 according to the present invention, is disposed over the circular metal plate 24. The covering sheet 28 has a larger circular shape than the circular metal plate 24, and a portion of the covering sheet 28 that extrudes from the circular metal plate 24 is attached to the flexible membrane 20. Therefore, when the fully inflated flexible membrane 20 is viewed in the flow direction, the circular metal plate 24 and the covering sheet 28 are disposed nearer the upper surface 14U of the conduit 14 than the flexible membrane 20.

As shown in FIGS. 1A and 1B, a metal detector 30 is mounted on the upper surface 14U of the conduit 14 at a position which corresponds to the circular metal plate 24 when the flexible membrane 20 has been completely inflated. The metal detector 30 is electrically connected to an unillustrated display via a cable 32, and the display shows whether metal is present within a predetermined range of the metal detector 30. Sensitivity of the metal detector 30 is set so that the metal detector 30 detects the circular metal plate 24 only when the flexible membrane 20 has been completely inflated (i.e., when the circular metal plate 24 is most proximate to the metal detector 30) and does not detect the circular metal plate 24 when the flexible membrane 20 is only partially inflated (i.e., when the circular metal plate 24 is not most proximate to the metal detector 30). As long as sensitivity can be preset to detect metal in this manner, the metal detector 30 is not particularly limited. Any commonly used metal detector can be used by setting a predetermined sensitivity.

The circular metal plate 24 and the metal detector 30 thus comprise a structure 34 according to the present invention for detecting a fully inflated state of the flexible membrane 20.

Because the metal detector 30 does not detect the circular metal plate 24 when the flexible membrane 20 is deflated since the circular metal plate 24 is not proximate to the metal detector 30, the display shows that the flexible membrane 20 is not fully inflated, whereby an operator can verify that the flexible membrane 20 is deflated.

When air is supplied from the pump and the flexible membrane 20 is inflated, the circular metal plate 24 rises and approaches the metal detector 30. However, since the sensitivity of the metal detector 30 is set so that the metal detector 30 only detects the circular metal plate 24 when the flexible membrane 20 has been completely inflated, the metal detector 30 does not detect the circular metal plate 24 while the flexible membrane 20 is being inflated.

As shown in FIGS. 1A and 1B, when the flexible membrane 20 has been fully inflated and the covering sheet 28 contacts the upper surface 14U of the conduit 14, the metal detector 30 detects the circular metal plate 24 and sends this information to the display. Therefore, by looking at the display, an operator can verify that the flexible membrane 20 is fully inflated. On the basis of this information, the air supply from the pump can be manually or automatically stopped (with an unillustrated controller) so that air is not excessively supplied.

With the structure 34 of the present embodiment, the metal detector 30 detects that the flexible membrane 20 has been completely inflated by detecting the presence of the metal member (i.e., the circular metal plate 24) disposed on the flexible membrane 20. Detection of the fully inflated state is accomplished without detecting force (compressive force or pressing force) exerted by the fully inflated flexible membrane 20. Hence, the metal detector 30 is wholly unaffected by fluid pressure in the conduit 14. Namely, since the metal detector 30 detects the metal member only when the flexible membrane 20 has been completely inflated, the fully inflated state of the flexible membrane 20 can be more accurately detected than conventional methods.

Figures 4A, 4B:
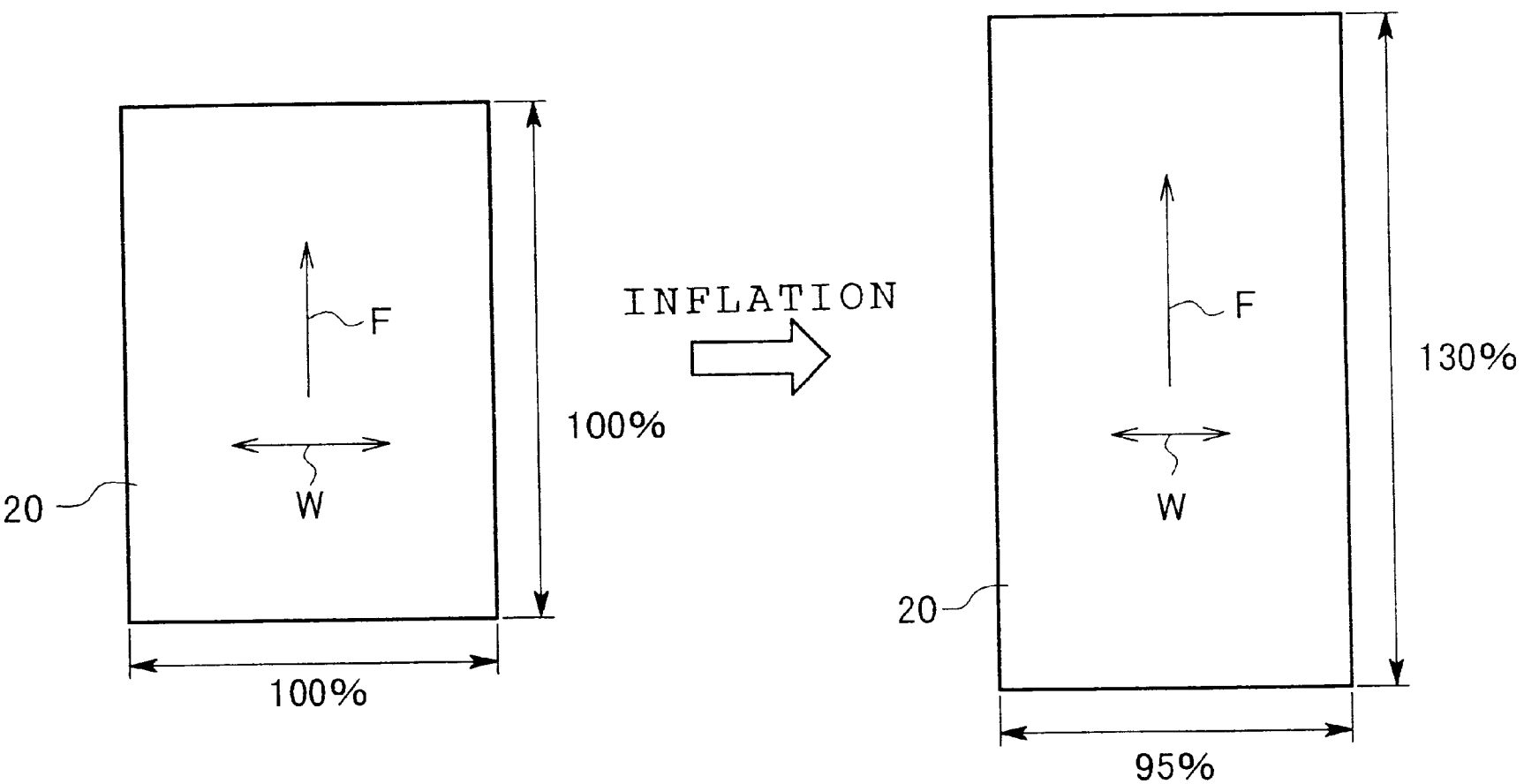
FIG. 4A is an explanatory view of the flexible membrane in a deflated state.
FIG. 4B is an explanatory view of the flexible membrane in an inflated state.

While the circular metal plate 24 may be attached to the flexible membrane 20 and/or the covering sheet 28, it is preferable to dispose the circular metal plate 24 therebetween without attaching it to either. The reason for this is because, when the flexible membrane 20 has been fully inflated (as shown in FIG. 4B), extension percentages of the flexible membrane 20 in the longitudinal and width directions respectively differ from those when the flexible membrane 20 is not inflated (as shown in FIG. 4A). For example, when fully inflated, the flexible membrane 20 may extend about 30% in the longitudinal direction and contract about 5% in the width direction. Thus, by not attaching the circular metal plate 24 to the flexible membrane 20, the circular metal plate 24 remains unaffected by distortion of the flexible membrane 20, and extension and contraction of the flexible membrane 20 encounter none of the resistance that may be encountered if the circular metal plate 24 is attached thereto.

It is likewise not preferable to attach the circular metal plate 24 to the covering sheet 28, because the covering sheet 28 is also presumably distorted with the flexible membrane 20 due to the periphery of the covering sheet 28 being attached to the flexible membrane 20. Thus, by not attaching the circular metal plate 24 to the covering sheet 28, contact between the circular metal plate 24 and the covering sheet 28 is unaffected by distortion of the covering sheet 28, and extension and contraction of the covering sheet 28 encounter none of the resistance that may be encountered if the circular metal plate 24 is attached thereto.

The shape of the metal member of the present invention is not necessarily limited. A metal member having any shape detectable by the metal detector 30 (e.g., a sphere, a rectangular parallelepiped, a block, etc.) can be used in the present invention.

The metal member is preferably tabular, because a tabular metal plate hardly protrudes from the flexible membrane 20 and can be made light-weight. The thickness of the metal plate 22 is preferably at most 10 mm. However, if the metal plate 22 is excessively thin, strength thereof is reduced. Thus, in order to maintain sufficient strength, thickness of the metal plate 22 is preferably at least 2 mm.

Figure 5:
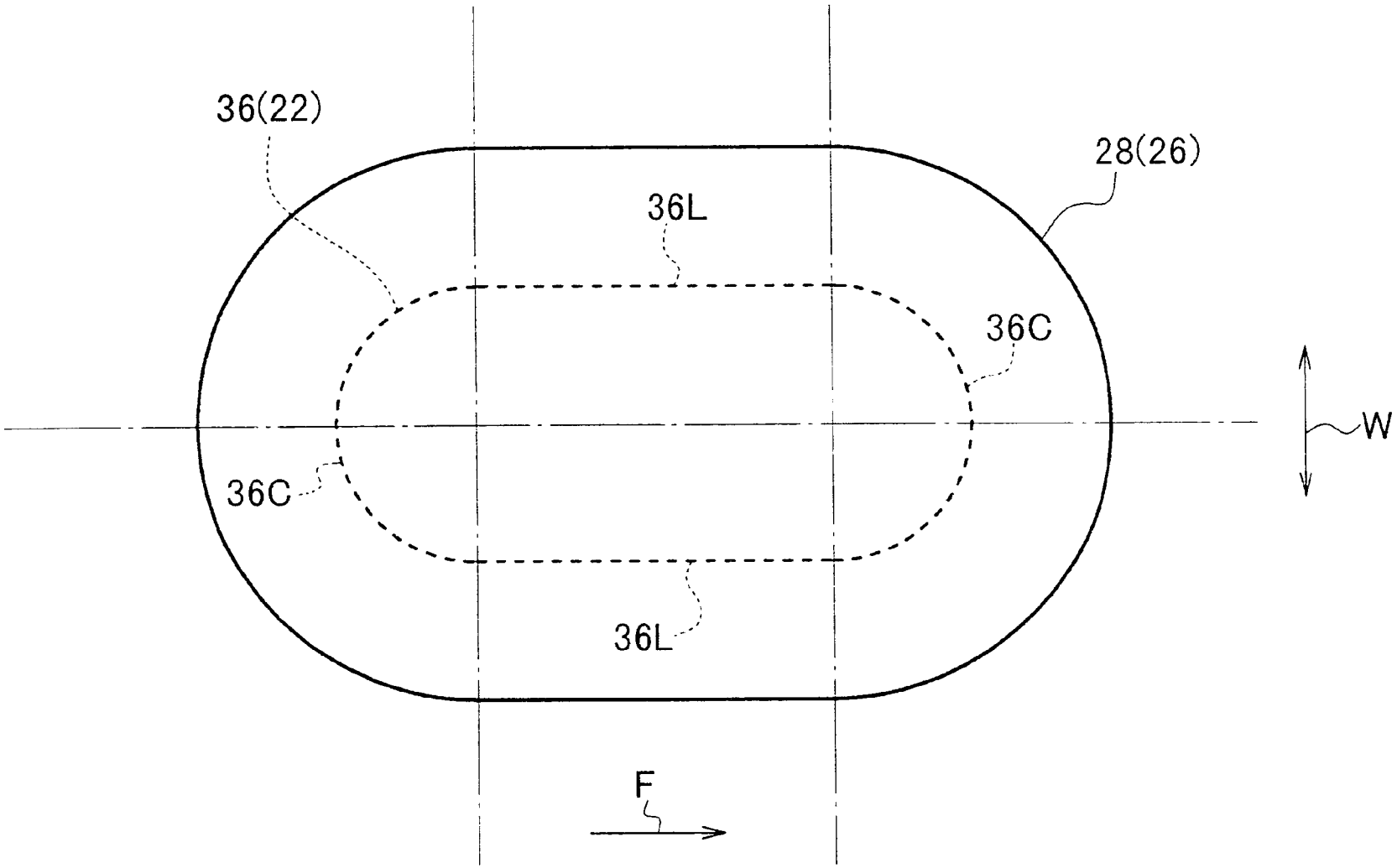
FIG. 5 is a front view showing the metal plate and a covering sheet according to a modification of the embodiment.

As shown in FIG. 5, the metal plate 22 may be an elliptical metal plate 36 (that has a shape in which semicircles 36C are continuously connected to ends of two parallel lines 36L). Particularly, when fluid flow is applied to the fully inflated flexible membrane 20, the center of the flexible membrane 20 and its vicinity may be shifted downstream by the fluid pressure. Therefore, if the elliptical metal plate 36 is disposed so that a longitudinal direction thereof corresponds to the flow direction, the effect of the shift is reduced (preferably eliminated), and the elliptical metal plate 36 can be reliably detected. When the portion of the fully inflated flexible membrane 20 at which the elliptical metal plate 36 is disposed is shifted in another direction, the elliptical metal plate 36 should be orientated in correspondence with that direction. In contrast, when the circular metal plate 24 shown in FIGS. 2 and 3 is disposed, orientation thereof does not need to be considered.

Further, when the elliptical metal plate 36 is used as the metal plate 22, the covering sheet 28 is also preferably elliptical, as shown in FIG. 5.

Figure 6:
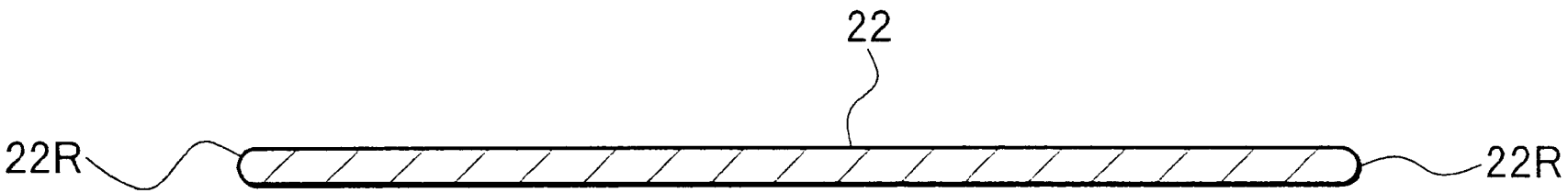
FIG. 6 is a cross-sectional view of the metal plate of FIG. 5.

When the flexible membrane 20 is fully inflated, the covering sheet 28 curves upwards to have a generally hemispherical shape. Therefore, if the metal member has sharp portions, local loads from the sharp portions are applied to the covering sheet 28, and the covering sheet 28 may be damaged by local stresses. Accordingly, corners of the metal member are preferably chamfered such that the metal member has no sharp portions to thereby reduce the local loads from the metal member and prevent the covering sheet 28 from being damaged. For example, when the circular metal plate 24 or the elliptical metal plate 36 is used as the metal member, the entire periphery thereof viewed in a normal direction has a predetermined or smaller value of curvature (i.e., the periphery is substantially chamfered). As shown in FIG. 6, when a cross-section (or an end face) of the metal plate 22 in the thickness direction is viewed, ends thereof may be rounded in the thickness direction to form chamfered portions 22R.

Figure 7:
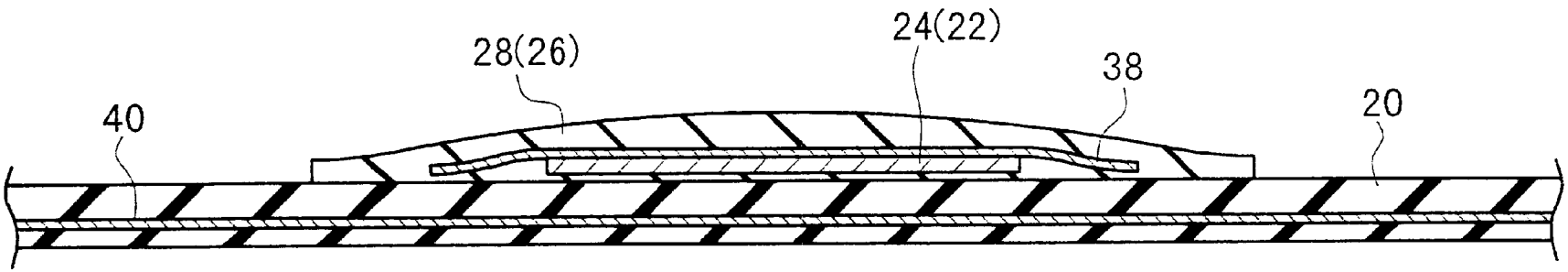
FIG. 7 is a cross-sectional view showing a cloth member disposed between the metal plate and the covering sheet according to the embodiment.

As shown in FIG. 7, a cloth member 38 for covering at least some of the corners of the metal plate 22 may also be disposed between the metal plate 22 (metal member) and the covering sheet 28 to ease loads applied from the corners to the covering sheet 28 and prevent the covering sheet 28 from being damaged. The flexible membrane 20 may include the reinforcing cloth 40 therein as shown in FIG. 7. The reinforcing cloth 40 has flexibility which can follow at least the flexibility of the flexible membrane 20. Accordingly, a structure is possible in which, for example, the metal plate 22 may be covered with the cloth member 38 made of the same material as the reinforcing cloth 40 and the cloth member 38 may be covered with the covering sheet 28.

As long as the metal member is reliably detected by the metal detector 30 only when the flexible membrane 20 is completely inflated, the position at which the metal member is disposed is not particularly limited. However, the metal member is preferably disposed at the center (when viewed in a normal direction) of the flexible membrane 20, because the metal member at this position is moved in a large amount when the flexible membrane 20 is inflated and deflated, whereby it can be reliably identified whether the flexible membrane 20 is inflated or not by detecting the metal member.

As long as the metal member is detected by the metal detector 30, the material used therefor is not limited, and, for example, iron, stainless steel, aluminum or the like can be used. When the metal member is made of iron, the iron is preferably galvanized to prevent the metal member from rusting in the event that the covering member becomes damaged and the metal member comes into contact with water. When the metal member is made of a non-corrosive material such as stainless steel or aluminum, it is not necessary to rust-proof the metal member. However, depending upon the type of fluid flowing in the conduit 14, it is preferable to subject the non-corrosive material as needed to rust or other proofing to raise durability.

The covering member 26 of the present invention is not limited to the covering sheet 28, and any member that can cover and protect the metal member may be used as the covering member 26. The metal member may be covered with only the covering sheet 28, or with both the cloth member 38 and the covering sheet 28 as described above. The metal member may be completely covered or partially covered, but it is of course preferable that the entire metal member is covered completely in order for the metal member to be protected more reliably. When the metal member is not attached to the flexible membrane 20 as described above, the metal member is preferably disposed between the covering member 26 and the flexible membrane 20 to prevent the metal member from inadvertently falling off of the flexible membrane 20 or from deviating out of position.

Figure 8:
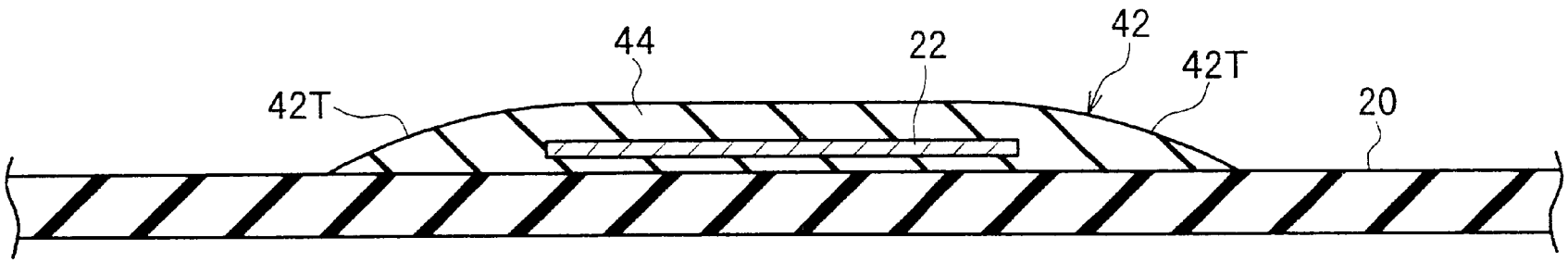
FIG. 8 is a cross-sectional view showing a covering unit according to another modification of the embodiment.

As shown in FIG. 8, it is also possible to cover the entire metal plate 22 with a covering material 44 such as rubber to form a tabular covering unit 42, and attach the covering unit 42 to the flexible membrane 20. In this case, the metal plate 22 may be covered with one or more sheets of vulcanized rubber or covered with rubber while vulcanization is conducted, in order to form the covering unit 42, and then, the covering unit 42 may be attached to the flexible membrane 20 while vulcanization is conducted again. Alternatively, unvulcanized rubber covering the metal plate 22 may be molded and attached to the flexible membrane 20 while vulcanization is conducted in order to form the covering unit 42. Regardless of how the covering unit 42 is formed, since the covering unit 42 can be preprocessed to some extent in a factory, on-site processes can be reduced for building a dam with the flexible membrane 20.

Figure 9:
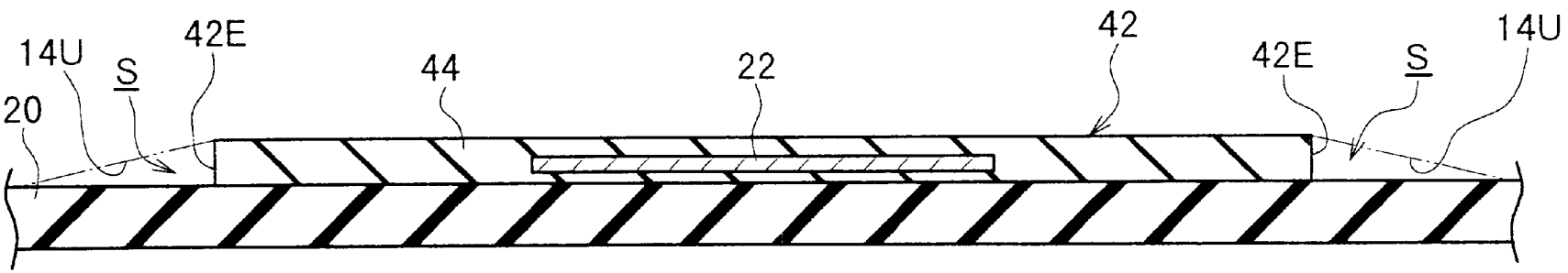
FIG. 9 is a cross-sectional view showing an example in which a periphery of the covering unit is not tapered.
Figure 10A:
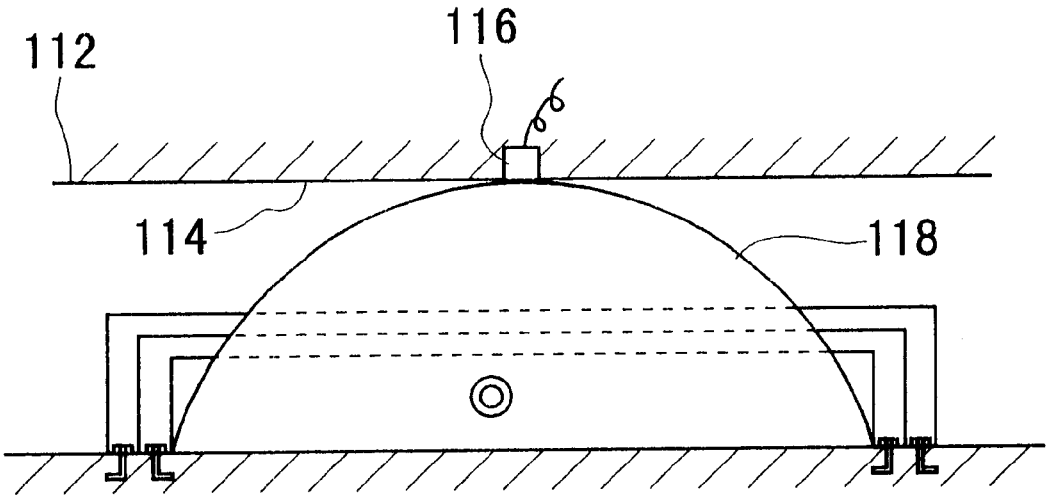
FIG. 10A PRIOR ART
FIG. 10A is a cross-sectional view of a conventional gate.
Figure 10B:
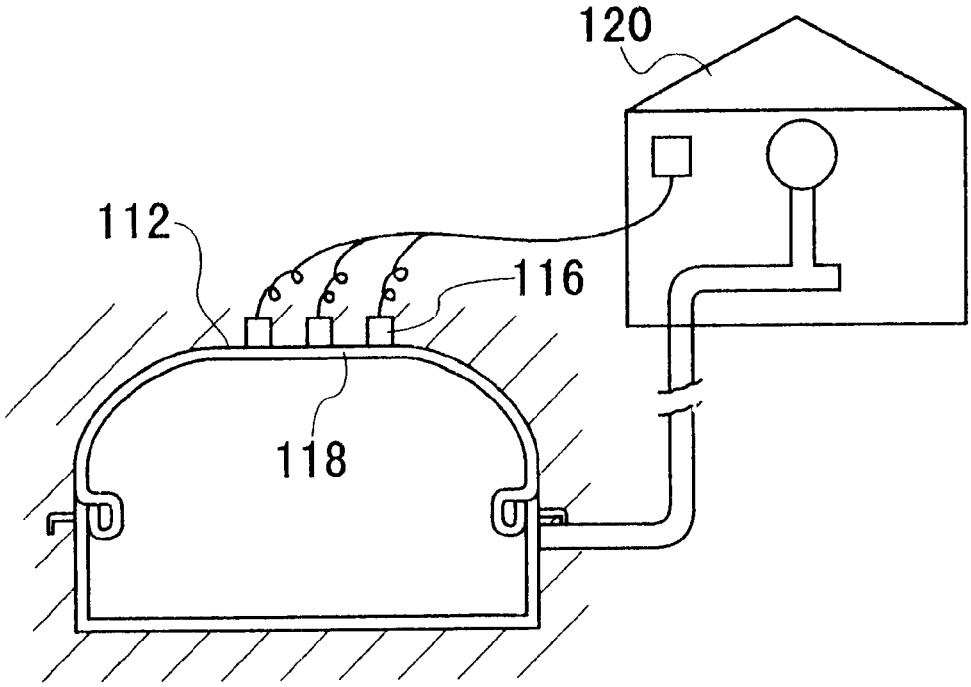
FIG. 10B PRIOR ART
FIG. 10B is a schematic view of the conventional gate of FIG. 10A.

As shown in FIG. 8, it is preferable for the periphery of the covering unit 42 to gradually taper towards the flexible membrane 20 (indicated by a tapered portion 42T). When the periphery of the covering unit 42 does not taper but includes an end surface 42E forming a substantial right angle to the surface of the flexible membrane 20 as shown in FIG. 9, a clearance S is generated between the flexible membrane 20 and the conduit 14 even when the flexible membrane 20 has been completely inflated, whereby occlusion of the conduit 14 may be reduced. In contrast, when the covering unit 42 includes the tapered portion 42T, the clearance S is reduced (preferably eliminated), and the occlusion of the conduit 14 is improved.

If the covering unit 42 has the shape shown in FIG. 9, there is the potential for foreign substances flowing together with the fluid in the conduit 14 to become caught at the end surface 42E when the flexible membrane 20 is deflated. However, when the tapered portion 42T is formed, foreign substances can be prevented from being caught and durability of the covering unit 42 can be improved. The tapered portion 42T is preferably formed also in the covering sheet 28 shown in FIGS. 2, 3, 5 and 7.

The thickness of the covering member 26 is preferably at most 10 mm in order to reduce the amount of protrusion from the flexible membrane 20, and is preferably at least 2 mm in order to maintain sufficient strength.

As long as the covering member 26 can cover the metal member and has flexibility which can follow the flexibility of the flexible membrane 20, the material used therefor is not particularly limited. For example, the material may be the same kind of rubber as that of the flexible membrane 20, or may be another kind of rubber or resin.

The outside dimension of the metal plate 22 is preferably from 50 mm to 1,000 mm. When the outside dimension is at least 50 mm, the metal plate 22 can be reliably detected by the metal detector 30, and when the outside dimension is at most 1,000 mm, distortion and the stress applied from the fully inflated flexible membrane 20 can be reduced, and the weight of the gate 12 can be restricted. For example, the diameter of the circular metal plate 24 shown in FIGS. 2 and 3 should be from 50 mm to 1,000 mm. With respect to the elliptical metal plate 36 shown in FIG. 5, width in the direction of arrow W should be at least 50 mm, and length in the direction of arrow F should be at most 1,000 mm.

The outside dimension of the covering member 26 or the covering unit 42 can be optimally selected depending upon, for example, dimensions of the metal member and of the flexible membrane 20. When the outer edge of the covering member 26 or the covering unit 42 outwardly extrudes from that of the metal member by 100 mm or more, the metal member can be completely covered, and the extruding portion thereof can be securely attached to the flexible membrane 20.

In this embodiment, as a specific example, the circular metal plate 24 made of material SS400 having a thickness of 3.2 mm and a diameter of 300 mm was used as the metal plate 22, and the circular metal plate 24 was covered with the same rubber as that of the flexible membrane 20 to form the covering unit 42 shown in FIG. 8 (diameter: 600 mm; thickness of rubber above and below the circular metal plate 24: 4 mm and 2 mm). The covering unit 42 was then attached to the center of the flexible membrane 20 by self-vulcanizing to form the gate 12. The flexible membrane 20 was repeatedly inflated and deflated ten times with an internal pressure of 30 kPa, but no troubles, such as the covering unit 42 becoming separated from the flexible membrane 20 and the rubber of the covering unit 42 sustaining damage, were experienced.

According to the present invention, an inflated state of a flexible membrane dam can be accurately detected without being affected by fluid pressure.

What is claimed is:

1. A structure for detecting an inflated state of a dam formed by a flexible membrane disposed in a culvert, with the flexible membrane being inflated due to fluid being supplied thereto and being deflated due to fluid being discharged therefrom, said structure comprising:

a metal member mounted on the flexible membrane; and a metal detector for detecting the metal member, the metal detector being mounted in the culvert at a position corresponding to the metal member when the flexible membrane has been inflated.

2. The structure of claim 1, wherein the metal member is mountable at a substantial center of the flexible membrane when viewed in a direction in which the flexible membrane inflates.

3. The structure of claim 1, wherein the metal member comprises a tabular metal plate.

4. The structure of claim 3, wherein the metal plate comprises an outside dimension within a range of from 50 mm to 1,000 mm.

5. The structure of claim 3, wherein the metal plate comprises a thickness within a range of from 2 mm to 10 mm.

6. The structure of claim 1, further comprising a covering member for covering at least part of the metal member.

7. The structure of claim 6, wherein the metal member is not attached to the flexible membrane.

8. The structure of claim 7, wherein a covering unit that includes the metal member and the covering member is attachable to the flexible membrane.

9. The structure of claim 7, further comprising a cloth member for covering at least some corners of the metal member disposed between the metal member and the covering member.

10. The structure of claim 6, wherein a periphery of the covering member tapers away from a center of the covering member.

11. The structure of claim 10, wherein at least some corners of the metal member are chamfered.

12. The structure of claim 11, wherein the metal plate is substantially circular.

13. The structure of claim 11, wherein the metal plate is substantially elliptical.

14. The structure of claim 6, wherein an outer edge of the covering member outwardly extrudes from that of the metal member by 100 mm or more.

15. The structure of claim 1, wherein the metal member comprises rust-proofing.

16. A method for detecting an inflated state of a dam formed by a flexible membrane disposed in a culvert, the method comprising the steps of:

(a) disposing a metal member on the flexible membrane;

(b) mounting a metal detector on an inner surface of the culvert; and (c) adjusting a position of at least one of the metal member and the metal detector so that the metal detector detects the metal member only when the flexible membrane has been inflated.

17. The method of claim 16, wherein the step of adjusting includes disposing the metal member on a portion of the flexible membrane that contacts the inner surface of the culvert when the flexible membrane has been completely inflated.

18. The method of claim 17, further comprising a step of covering the metal member with a covering member.

19. The method of claim 16, further comprising a step of adjusting sensitivity of the metal detector so that the metal detector detects the metal member only when the flexible membrane has been completely inflated.

20. A method of detecting inflation state of an inflatable membrane in a dam disposed in a culvert, the method comprising the steps of:

(a) mounting a detectable component on one of the membrane and the culvert;

(b) mounting a sensor operable for detecting the component on the other of the membrane and the culvert;

(c) adjusting at least one of the detectable component and the sensor so that the sensor detects the component only after the inflatable membrane has reached a predetermined inflation state; and (d) determining the inflation state of the inflatable membrane based on when the sensor detects the detectable component.

21. The method of claim 20, wherein the step of adjusting includes adjusting sensitivity of the sensor.

22. The method of claim 20, wherein the step of adjusting includes adjusting position of at least one of the detectable component and the sensor.

* * * * *